US005695163A

United States Patent [19]

Tayar

[11] Patent Number: 5,695,163

[45] Date of Patent: Dec. 9, 1997

[54] WALL-MOUNTED SHELVING SYSTEM OR SIMILAR ARTICLE

[76] Inventor: Memduh Ali Tayar, 430 W. 14th St., Suite 408, New York, N.Y. 10014

[21] Appl. No.: 436,932

[22] Filed: May 8, 1995

Related U.S. Application Data

[63] Continuation-in-part of Ser. No. 11,289, Jul. 30, 1993, Pat. No. Des. 358,321.

[51] Int. Cl.[6] ..... A47G 29/02

[52] U.S. Cl. ..... 248/243; 248/250; 248/225.21

[58] Field of Search ..... 248/243, 245, 248/249, 250, 225.21

[56] References Cited

U.S. PATENT DOCUMENTS

| | | | |
|---|---|---|---|
| D. 286,742 | 11/1986 | Gohrig . | |
| 891,660 | 6/1908 | Boeck | 248/245 X |
| 1,149,541 | 8/1915 | Rees | 248/225.21 X |
| 1,830,438 | 11/1931 | Miller | 248/243 X |
| 3,631,821 | 1/1972 | Zachariou | 248/243 X |
| 3,784,025 | 1/1974 | Dumit | 248/243 X |
| 3,859,763 | 1/1975 | Dahm | 248/243 X |
| 3,901,164 | 8/1975 | Urti | 248/245 X |
| 4,496,262 | 1/1985 | Sangster | 248/225.21 X |
| 4,765,575 | 8/1988 | Bergl et al. | 248/250 |
| 4,799,643 | 1/1989 | Shepard | 248/250 X |
| 4,915,338 | 4/1990 | Guth | 248/250 |
| 4,934,642 | 6/1990 | Baron et al. . | |
| 5,456,435 | 10/1995 | Sweeney | 248/243 X |

FOREIGN PATENT DOCUMENTS 2053666 2/1981 United Kingdom .

*Primary Examiner*—Ramon O. Ramirez
*Assistant Examiner*—Stephen S. Wentsler
*Attorney, Agent, or Firm*—Curtis, Morris & Safford, P.C.

[57] ABSTRACT

A wall-mounted shelving system is provided including a wall-mounted track and a cantilevered bracket both based on aluminum extrusions having structural cross-sections and a metal locking pin. The track has a flange member which is periodically machined to accept mounting screws and a web member with through-holes providing for vertical adjustability of the bracket. The bracket is sliced from a special extrusion and machined in the back to slide on to the track. The hook shaped integral part of the bracket allows for the pin to slide through the bracket and position it vertically. The shelving plane slides into the opening between the two cantilevering structural extension members of the bracket and is supported at least at two points without utilizing any positive connection between shelving material and the bracket.

8 Claims, 3 Drawing Sheets

12
18
22
26
28
24
20a
42b
10
42a
34a
46
44a
30
40a
16
48
33
49
14
54
50
34b
51
32
40b
52
20b
40c

WALL-MOUNTED SHELVING SYSTEM OR SIMILAR ARTICLE

CROSS-REFERENCE TO RELATED APPLICATIONS

This application is a continuation-in-part application of U.S. Des. patent application. Ser. No. 29/011,289, filed Jul. 30, 1993, D.358,321 which is incorporated herein by reference.

FIELD OF THE INVENTION

The present invention relates generally to adjustable shelving systems, and more particularly, to shelf supporting assemblies which are comprised of wall-mounted vertical standards and adjustable shelf supporting cantilever brackets.

BACKGROUND OF THE INVENTION

Support assemblies and the like, using vertical standards and shelf supporting elements which may be easily assembled to each other and adjusted for variations in height without tools and auxiliary locking screw or levers, are common on the market.

Examples of such assemblies are found in U.S. Pat. No. 3,136,520 to Reiss, U.S. Pat. No. 3,234,897 to Berk, U.S. Pat. No. 3,502,293 to Bard, U.S. Pat. No. 3,604,669 to Asher and U.S. Pat. No. 4,531,698 to Sharber. Although such previous assemblies have been found adequate in terms of load-bearing capacity, they do not provide for a high quality finish of the shelving system and do not provide for adequate freedom in shaping the cross-section of the support assembly.

OBJECTS OF THE INVENTION

Therefore, it is an object of the present invention to provide a shelf supporting system which avoids the aforementioned disadvantages of the prior art.

An additional object of the present invention is to provide a shelf supporting assembly made by an aluminum extrusion process to obtain a high quality finish.

It is a further object of the present invention to provide a shelf supporting assembly which provides for an adequate load bearing capacity.

Still another object of the present invention is to provide an aluminum extrusion process for forming a shelf supporting assembly which provides for freedom in shaping the cross-section of the assembly.

Various other objects, advantages and features of the present invention will become readily apparent from the ensuing detailed description and the novel features will be particularly pointed out in the appended claims.

SUMMARY OF THE INVENTION

These as well as other objects are accomplished by providing a wall-mounted shelving system comprising of a wall-mounted track and cantilevered bracket both formed of aluminum extrusions having structural cross-sections and a metal locking pin. The track has a flange member which is periodically machined to accept mounting screws and a web member with through-holes providing vertical adjustability of the bracket. The bracket is sliced from a special extrusion and machined in the back to slide on to the track. A hook-shaped integral protrusion of the bracket allows for the pin to slide through the bracket and position it vertically at the desired position. The shelving plane slides into the opening between the two cantilevering structural members of the bracket and is supported at least at two points without utilizing any positive connection between shelving material and the bracket.

BRIEF DESCRIPTION OF THE DRAWINGS

The following detailed description, given by way of example, will best be understood in conjunction with the accompanying drawings in which.

DETAILED DESCRIPTION OF THE PREFERRED EMBODIMENT

Figure 1:
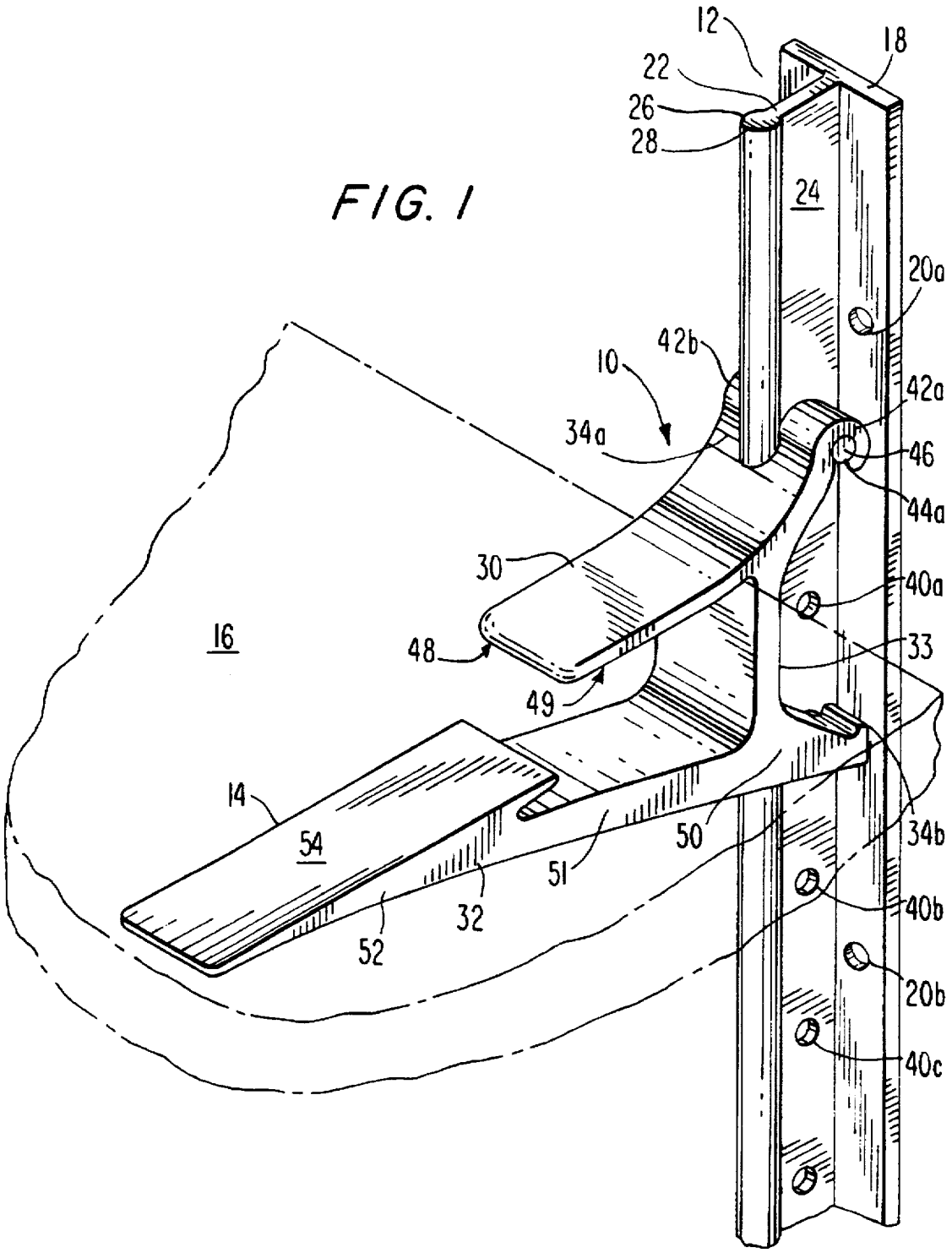
FIG. 1 is a partial perspective view of a preferred embodiment of a wall-mounted shelving system in accordance with the teachings of the present invention specifically illustrating a partial wall-mounted track, a bracket and a partial shelving plane which is supported by the bracket.

Referring to the drawings, wherein like reference numerals are used throughout and in particular to FIG. 1, there is illustrated a preferred embodiment of a wall-mounted shelving system 10 in accordance with the present invention. As shown in FIG. 1, the wall-mounted shelving system 10 of the present invention includes a vertically extending wall-mounted track 12 and a bracket 14 which is designed to be retained on the wall-mounted track 12 to support a shelf 16 at varying heights.

Of course, in order to support the shelf 16 a pair of these wall-mounted shelving systems is required with mating tracks and brackets. For simplicity, only one of these wall-mounted shelving systems is illustrated in FIG. 1.

In many previous wall-mounted shelving systems, folded sheet-metal tracks were perforated to accept stamped metal brackets which cantilever to support the shelf plane. In contrast to those previous systems, the wall-mounted shelving system of the present invention offers a high quality alternative which utilizes aluminum extrusion profiles in manufacturing of both the track 12 and the bracket 14. Machined aluminum extrusions allow by definition for a higher surface quality and a greater freedom in ornamental shaping than metal stamping and folding, while offering the potential for bearing capacities required by law for library stacks.

As is shown in FIG. 1, the wall-mounted track 12 is shaped in the form of a structural T-section. The wall-mounted track 12 includes a vertically extending flange member 18 having a plurality of counter-sunk holes 20*a, b*, etc. provided therein in order to allow the track 12 to be mounted against a wall surface by fastening members, such as screws or the like. In the mounted position, the flange member 18 remains flush with the wall surface. The wall-mounted track 12 further includes a web member 22 extending outwardly generally normal to the flange member 18. The web member 22 includes a stem member 24 and a ball member 26 at an end 28 thereof. As will be discussed in more detail below, the ball member 26 both structurally strengthens the track 12 and provides an ornamental element therefore.

Figure 3:
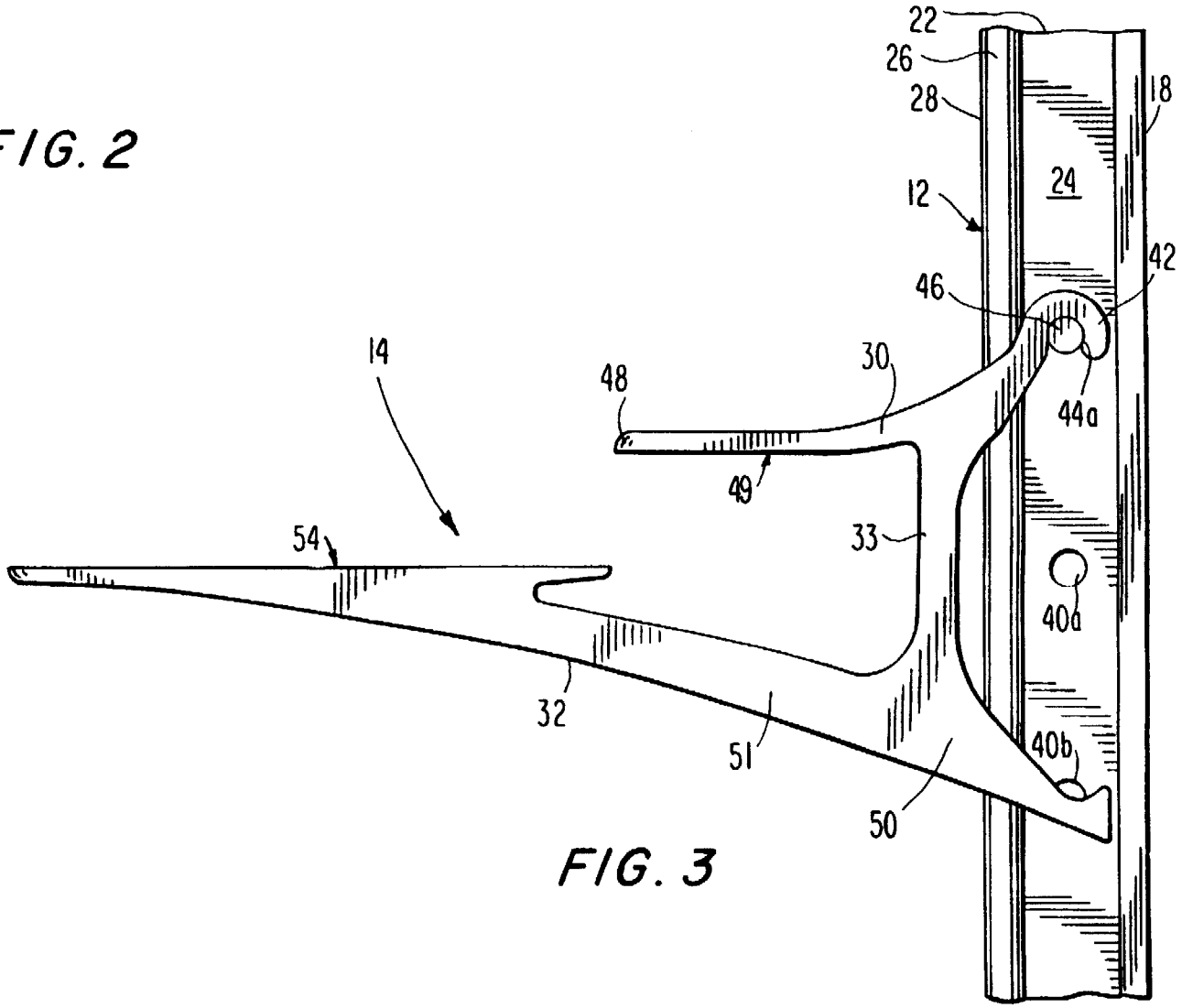
FIG. 3 is a side elevational view of the wall-mounted track and bracket of the portion of the wall-mounted shelving system shown in FIG. 2.
Figure 2:
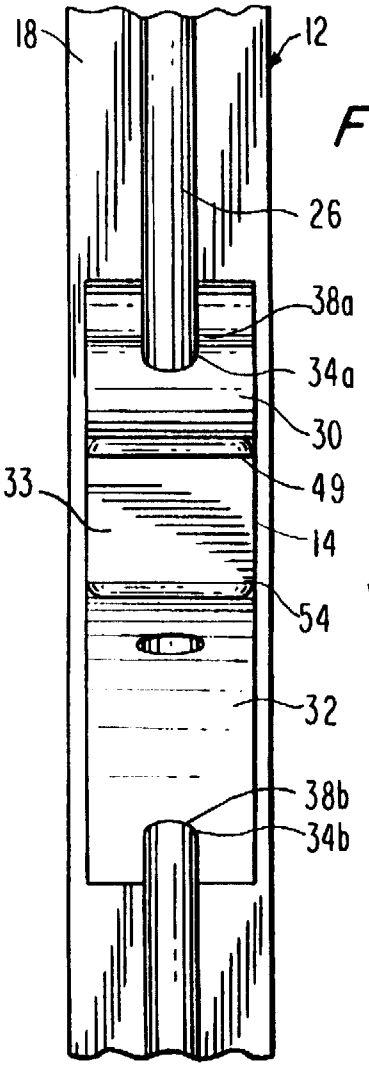
FIG. 2 is a partial front elevational view of the wall-mounted track and bracket of the wall-mounted shelving system of FIG. 1.
Figure 4:
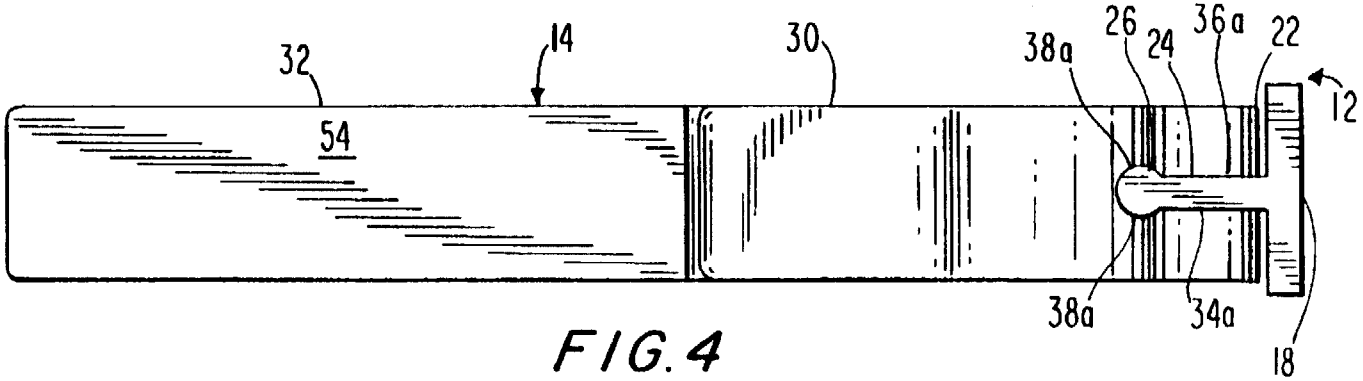
FIG. 4 is a top plan view of the wall-mounted track and bracket of the wall-mounted shelving system of FIG. 1.
Figure 6:
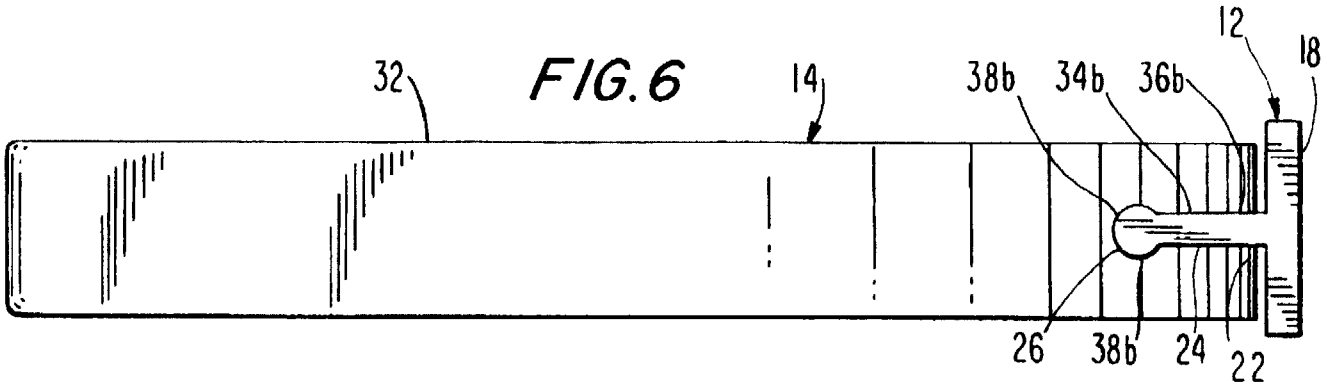
FIG. 6 is a bottom plan view of the wall-mounted track and bracket of the wall-mounted shelving system of FIG. 1.
Figure 5:
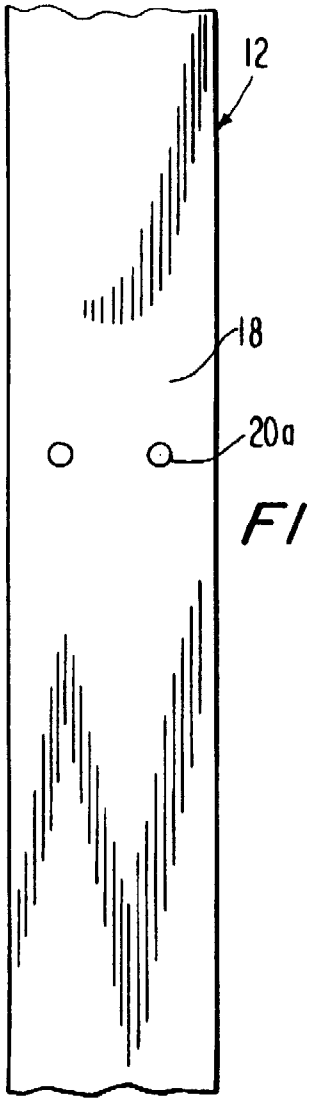
FIG. 5 is a partial rear elevational view of the wall-mounted track of the wall-mounted shelving system of FIG. 1.

As is best shown in FIGS. 1 and 3, the bracket 14 includes a cantilevered upper structural member 30 and a cantilevered lower structural member 32 which are joined to one another by a central vertically extending web member 33. Each of the upper and lower structural members 30 and 32 includes respective slots 34*a* and *b* (see FIGS. 4 and 6) in the rearward section thereof through which the web member 22 of the track 12 is capable of being insertably retained. FIGS. 4 and 6 illustrate that each of the slots 34*a* and *b* include a generally straight portion, such as 36*a* and *b*, and a generally circular portion, such as 38*a* and *b*. In the retained position of the bracket 14 to the track 12, the stem member 24 of the web member 22 of the track is received within the straight portions 36*a* and *b* of the slots 34*a* and *b* of the bracket. In addition, the ball member 26 of the web member of the track is received within the circular portions 38*a* and *b* of the slots 34*a* and *b* of the bracket. Accordingly, these slots 34*a* and *b* are defined by the cross-section of the web member 22 of the track 12 but also are dimensioned so as to provide enough play for ease of sliding motion of the bracket 14 along the track 12.

In order to reliably retain the bracket 14 to the track 12 at varying heights, FIG. 1 best illustrates the bracket mounting assembly of the wall mounted shelving system of the present invention. More specifically, the stem member 24 of the web member 22 of the track 12 includes a plurality of vertically spaced through-holes, such as 40*a, b, c*, etc., extending the length thereof. The upper structural member 30 of the bracket 14 includes a pair of hook-shaped protrusions 42*a* and *b* each having aligned openings, such as 44*a* and *b*. When the openings 44*a* and *b* are aligned with the desired through-hole, such at 40*a, b, c*, etc., to set the vertical height of the shelf, a locking pin 46 is inserted through the aligned openings 44*a* and *b* and desired through-hole to vertically lock the bracket 14 along the track 12. This pin 46 can be removed by merely pushing it outwardly with finger force, and thus does not need to be removed with a tool. Moreover, since the pin is easily removed, the bracket mounting assembly of the wall-mounted support system of the present invention allows for simple readjustment of the shelf bracket at a different vertical height.

In the preferred embodiment of applicant's wall-mounted shelving system, the upper structural member 30 of the bracket slopes downwardly from the hook-shaped protrusions 42*a* and *b* to a relatively flat shelf bearing surface portion 48 having a shelf bearing surface 49 provided on the underside thereof. The lower structural member 32 of the bracket slopes gently upwardly from a rearward counterbalancing section 50 thereof to a forward section 52 including a relatively flat shelf bearing support surface 54 extending upwardly therefrom. The shelf 16 is then insertably retained between the respective shelf bearing surfaces 49 and 54 of the upper and lower structural members 30 and 32 of the bracket 14.

As a result of the design of the bracket 14, the upper structural member prevents the overturning of the shelf plane 16 while the download is supported by the counterbalancing section 50 including stem portion 51 of the lower structural member 32. The design of the shelf bearing surface 54 of the lower structural member 32 and the cross-section of the rearward counterbalancing section 50 is a function of the load bearing capacity of the specific bracket and is adjustable based upon the requirements concerning each case load. The force of the load bearing on the counterbalance portion 50 of the lower structural member 32 is transferred through the lower protrusion 34*b* of the bracket 14 to the flange member 18 of the track 12 and thus to the load bearing surface of the wall behind.

As can be seen from FIG. 1, the bracket 14 is manufactured by slicing a custom extrusion perpendicular to the direction of extrusion. The cross section of the extrusion combines in one piece the various functions the bracket has to fulfill, e.g. the attachment to the pin and wall-mounted track as well as the support for the shelf plane and an upper structural member to prevent overturning of the shelf plane. Furthermore, the cross-section defines the ornamental shape of the bracket.

In use, the minimal assembly of this wall-mounted shelving system allows for two vertical tracks to be mounted on a wall surface at a distance from each other in accordance with the load bearing capacity of the shelving plane. One bracket on either track is then slid onto each track and is secured with the pin 46 at vertically corresponding positioning holes, such as 40*a, b, c*, etc. The final step in assembly comprises inserting a shelf 16 into the space provided between the upper structural member 30 and the bearing surface 54 of the lower structural member and allowing it to cantilever on beyond the outer edges of the bracket.

While the present invention has been particularly show and described with reference to a preferred embodiment, it will be readily apparent to those of ordinary skill in the art that various changes and modifications may be made therein without departing from the spirit and scope of the invention. It is intended that the appended claims be interpreted as including the foregoing as well as various other such changes and modifications.

What is claimed is:

1. A wall-mounted shelving system comprising:

a wall-mounted track;

a means for retaining a bracket to said track;

said bracket extending generally horizontally and capable of supporting a shelf in a generally horizontally extended position;

said track and said bracket are formed of extruded aluminum;

said bracket including a pair of spaced-apart upper and lower support surfaces for retaining the shelf therebetween so that no positive connection is required between said track and the shelf as the shelf is retained in said generally horizontal position solely by the load bearing capacities of said upper and lower support surfaces of said bracket, wherein said bracket is secured to said track at a single positive mating connection thereof; and said means for releasably retaining said bracket to said track at varying heights along said track includes: a plurality of vertically-spaced through-holes provided along a web member of said track at predetermined vertical heights, said web member extends outwardly and generally perpendicular to a wall surface; a pair of hook-shaped protrusions being provided in said bracket and defining a pair of openings to be aligned with one of said plurality of vertically-spaced through-holes at the desired vertical height; and pin means for retaining said bracket at the desired vertical height along said track whereby said pin means passes through said aligned openings of said bracket and said through-hole of said track.

2. A wall-mounted shelving system for mounting a shelf in a generally horizontal position relative to a wall surface, said wall-mounted shelving system comprising:

a track adapted to be mounted to the wall surface;

a bracket means for receiving and retaining the shelf therein which is mounted to said track;

a means for releasably securing said bracket means to said track at varying height along said track wherein said bracket means is secured to said track at a single positive mating connection thereof; said means for releasably securing said bracket means to said track at varying heights along said track includes: a plurality of vertically-spaced through-holes provided along a web member of said track at predetermined vertical heights, said web member extends outwardly and generally perpendicular to the wall surface; a pair of hook-shaped protrusions being provided in said bracket means and defining a pair of openings to be aligned with one of said plurality of vertically-spaced through-holes at the desired vertical height; and a pin means for retaining said bracket means at the desired vertical height along said track whereby said pin means passes through said aligned openings of said bracket means and said through-hole of said track;

a means for supporting the shelf in said bracket in a generally horizontal position relative to the wall surface without employing fasteners; and wherein said bracket means includes a pair of spaced-apart upper and lower support surfaces for retaining the shelf therebetween so that no positive connection is required between said track and the shelf as the shelf is retained in a generally horizontal orientation solely by the load bearing capacities of said upper and lower support surfaces.

3. The wall-mounted shelving system of claim 2 wherein said track and said bracket means are formed of extruded aluminum.

4. The wall-mounted shelving system of claim 2 wherein said means for supporting the shelf in said bracket means in a generally horizontal position relative to the wall surface includes:

upper and lower structural members of said bracket means separated by a central web member, said upper structural member having a relatively flat shelf bearing surface provided on the underside thereof, said lower-structural member of said bracket means sloping gently upwardly from a rearward counterbalancing section thereof to a forward section including a relatively flat shelf bearing support surface extending upwardly therefrom, said shelf being insertably retained between said shelf bearing surfaces of said upper and lower structural members of said bracket means.

5. The wall-mounted shelving system of claim 2 wherein said track includes a vertically extending flange member having a plurality of counter-sunk holes provided therein in order to allow the track to be mounted against the wall surface.

6. The wall-mounted shelving system of claim 5 wherein:

said web member of said track further including a stem member and a ball member at an end thereof; and said bracket means further includes an upper structural member and a lower structural member each having respective slots through which said web member of said track is capable of being insertably retained, each said slot including a generally straight portion and a generally circular portion such that when said bracket means is retained along the track, said stem member of said web member of said track is received within said straight portions of said slots and said ball member of said web member of said track is received within said circular portions of said slots.

7. A wall-mounted shelving system for mounting a shelf in a generally horizontal position relative to a wall surface, said wall-mounted shelving system comprising:

a track including a vertically extending flange member having a plurality of counter-sunk holes provided therein in order to allow the track to be mounted against the wall surface, said track further including a web member extending outwardly generally normal to said flange member, said web member having a stem member and a ball member at an end thereof, said stem member having a plurality of vertically-spaced through-holes provided therealong at predetermined vertical heights;

a bracket for receiving and retaining the shelf therein which is mounted to the track, said bracket including an upper and a lower structural member separated by a central web member, said upper structural member having a pair of hook-shaped protrusions defining a pair of openings at one end thereof to be aligned with one of said plurality of vertically spaced through-holes at the desired vertical height, said upper structural member sloping downwardly from said hook-shaped protrusions to a relatively flat shelf bearing surface provided on the underside thereof, said lower structural member sloping gently upwardly from a rearward counterbalancing section thereof to a forward section including a relatively flat shelf bearing support surface extending upwardly therefrom spaced-apart from the shelf bearing surface of said upper structural member, said shelf being insertably retained between said shelf bearing surfaces of said upper and lower structural members, said upper and lower structural members each having respective slots through which said web member of said track is capable of being insertably retained, each said slot including a generally straight portion and a generally circular portion such that when said bracket is retained along said track, said stem member of said web member of said track is received within said straight portions of said slots and said ball member of said web member of said track is received within said circular portions of said slots;

pin means for retaining said bracket at the desired vertical height along said track whereby said pin means passes through said aligned openings of said bracket and said through-hole of said track and said pin means defines a single mating connection for securing said bracket to said track; and wherein said shelf bearing support surfaces retain the shelf therebetween so that no positive connection is required between said track and the shelf as the shelf is retained in a generally horizontal orientation solely by the load bearing capacities of said shelf bearing support surfaces.

8. The wall-mounted shelving system of claim 7 wherein said bracket and said track are formed of extruded aluminum.

* * * * *